US008384291B2

(12) United States Patent
Lin

(10) Patent No.: US 8,384,291 B2
(45) Date of Patent: Feb. 26, 2013

(54) BACKLIGHT PROTECTION CIRCUIT

(75) Inventor: Ching-Chung Lin, Miao-Li (TW)

(73) Assignee: Chimei InnoLux Corporation, Miaoli County (TW)

( * ) Notice: Subject to any disclaimer, the term of this patent is extended or adjusted under 35 U.S.C. 154(b) by 818 days.

(21) Appl. No.: 12/459,663

(22) Filed: Jul. 6, 2009

(65) Prior Publication Data

US 2010/0001651 A1 Jan. 7, 2010

(30) Foreign Application Priority Data

Jul. 4, 2008 (CN) ..... 2008 1 0068335

(51) Int. Cl.
*H05B 37/02* (2006.01)

(52) U.S. Cl. ..... 315/119; 315/121; 315/312

(58) Field of Classification Search ..... 315/119, 315/209 R, 225, 291, 312, 121, 129, 307, 315/308
See application file for complete search history.

(56) References Cited

U.S. PATENT DOCUMENTS 4,168,453 A * 9/1979 Gerhard et al. ..... 315/291
5,729,096 A 3/1998 Liu et al.
7,291,991 B2 * 11/2007 Chen ..... 315/307
7,291,992 B2 * 11/2007 Miyazaki ..... 315/307
7,372,213 B2 * 5/2008 Kuo et al. ..... 315/282
7,372,214 B2 * 5/2008 Song et al. ..... 315/291
7,564,194 B2 * 7/2009 Jang et al. ..... 315/291
2006/0290453 A1 * 12/2006 Park et al. ..... 336/69
2007/0171684 A1 * 7/2007 Fukumoto ..... 363/21.09
2008/0088257 A1 * 4/2008 Zhou et al. ..... 315/291
2008/0180038 A1 * 7/2008 Wang et al. ..... 315/246
2008/0252231 A1 * 10/2008 Huang et al. ..... 315/254
2009/0009097 A1 * 1/2009 Li et al. ..... 315/209 R

FOREIGN PATENT DOCUMENTS

CN 1972546 A 5/2007

* cited by examiner

*Primary Examiner* — Jacob Y Choi
*Assistant Examiner* — Ephrem Alemu
(74) *Attorney, Agent, or Firm* — Bacon & Thomas, PLLC

(57) ABSTRACT

A backlight protection circuit includes a driving circuit, two lamps, a pulse modulator, and a feedback circuit. The pulse modulator controlling the operating state of the driving circuit includes an over-voltage sampling end. Each of the two lamps includes a high voltage end connected to the driving circuit, and a low voltage end connected to the over-voltage sampling end through the feedback circuit. The pulse modulator stops the operation of the driving circuit when the voltage of the low voltage end exceeds a reference voltage.

13 Claims, 3 Drawing Sheets

BACKLIGHT PROTECTION CIRCUIT

BACKGROUND

1. Technical Field

The present disclosure relates to a backlight protection circuit.

2. Description of Related Art

In order to display an image, liquid crystals in a liquid crystal display (LCD) panel, require illumination from a light source such as a backlight module. A common backlight module includes a plurality of lamps and a pulse modulator which controls the operation of the lamps. When one of the lamps functions abnormally, the pulse modulator is adjusted to protect itself or the lamp.

A backlight protection circuit of the common backlight module uses high voltage end feedback circuits connected to outputs of driving circuits of the backlight protection circuit to provide over-voltage protection to the lamps. When operating in a high voltage environment, the elements in the high voltage end feedback circuits can wear out easily, reducing the reliability of the high voltage end feedback circuits, and thus reducing the reliability of the backlight protection circuit.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Figure 1:
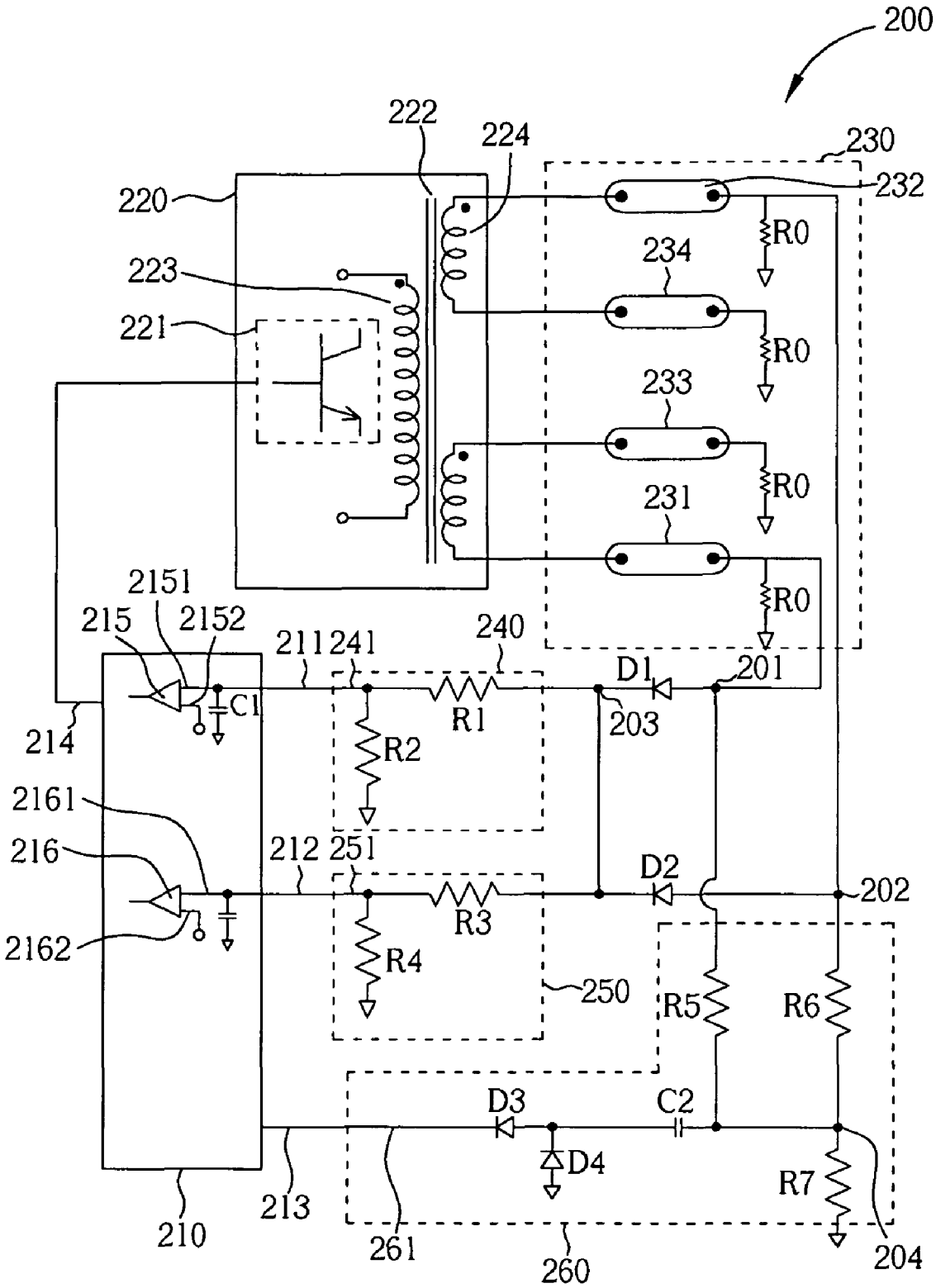
FIG. 1 is a circuit diagram of a backlight protection circuit according to the present disclosure.

FIG. 1 is a circuit diagram of a backlight protection circuit 200 according to the present disclosure. The backlight protection circuit 200 includes a pulse modulator 210, a driving circuit 220, a lamp set 230, a current feedback circuit 240, an over-voltage feedback circuit 250 and a pulse feedback circuit 260. The pulse modulator 210 controls the driving circuit 220 to generate a driving voltage to drive the lamp set 230. The current feedback circuit 240, the over-voltage feedback circuit 250 and the pulse feedback circuit 260 are connected to the lamp set 230 to monitor the operating state of the lamp set 230, each generating a feedback signal indicating the operating state of the lamp set 230 to the pulse modulator 210. The pulse modulator 210 controls the driving circuit 220 to adjust the driving voltage to be output according to the feedback signal. The feedback signal is a voltage signal.

The pulse modulator 210 is a pulse modulation chip, such as model OZ9938, OZ9939, for example. The pulse modulator 210 includes a current sampling end 211, a voltage sampling end 212, a pulse sampling end 213, an output end 214, a first comparator 215, a second comparator 216 and two filtering capacitors C1. The current sampling end 211 receives the current feedback signal of the current feedback circuit 240. A voltage of the current feedback signal is defined as Vif. The voltage sampling end 212 is used to receive the over-voltage feedback signal of the over-voltage feedback circuit 250. A voltage of the over-voltage feedback signal is defined as Vvf. The pulse sampling end 213 is used to detect the pulse signal of the pulse feedback circuit 260. The output end 214 is used to output control pulses to the driving circuit 220. The first comparator 215 includes a first signal end 2151 and a first reference end 2152. The first signal end 2151 is connected to the current sampling end 211, and is grounded through a filtering capacitor C1. The first reference end 2152 is connected to a first reference voltage Vref1. The second comparator 216 includes a second signal end 2161 and a second reference end 2162. The second signal end 2161 is connected to the voltage sampling end 212, and is grounded through a filtering capacitor C1. The second reference end 2162 is connected to a second reference voltage Vref2.

The driving circuit 220 includes a switch circuit 221 and a transformer 222. The switch circuit 221 receives control pulses output from the output end 214 of the pulse modulator 210 so as to cause the transformer 222 to generate an AC voltage. The AC voltage generated by the transformer 222 changes with the frequency or duty cycle of the control pulses. The transformer 222 includes a primary winding 223 and two secondary windings 224. The number of turns of the two secondary windings 224 are the same. The primary winding 223 and the two secondary windings 224 are wound in the same direction. The effective voltages of the two secondary windings 224 are Vo.

The lamp set 230 includes a first lamp 231, a second lamp 232, a third lamp 233, a fourth lamp 234 and four protecting resistors R0. The first lamp 231 and the third lamp 233 are connected in series through a secondary winding 224. The second lamp 232 and the fourth lamp 234 are connected in series through another secondary winding 224. The first lamp 231 and the fourth lamp 234 are connected to the same transformer terminals of the two secondary windings 224. The first lamp 231 and the second lamp 232 are connected to different transformer terminals of the two secondary windings 224. That is, the phases of the loaded driving voltages of the first lamp 231 and the second lamp 232 are opposite to each other. In this embodiment, the end of each lamp connected to the secondary winding 224 is defined as the high voltage end of the lamp; the other end is defined as the low voltage end of the lamp. The low voltage end of each lamp is grounded through a protecting resistor R0. To maintain normal operation of the lamp set 230, the allowable lowest effective voltage output by the driving circuit 220 is Vol, and the highest allowable effective voltage output by the driving circuit 220 is Voh. That is, to maintain normal operation of the lamp set 230, the effective voltage Vo output by the secondary winding 224 must exceed the allowable lowest effective voltage Vol, and be lower than the highest allowable effective voltage Voh. The allowable lowest effective voltage Vol and the highest allowable effective voltage Voh correspond to the first and second reference voltages Vref1 and Vref2 respectively. Corresponding to the allowable lowest effective voltage Vol output by the driving circuit 220, the low voltage end of each lamp has a lower voltage limit V1. Corresponding to the highest allowable effective voltage Voh output by the driving circuit 220, the low voltage end of each lamp has a higher voltage limit Vh.

The backlight protection circuit 200 further includes a first diode D1 and a second diode D2. An anode of the first diode D1 is connected to the low voltage end of the first lamp 231 through a first node 201. An anode of the second diode D2 is connected to the low voltage end of the second lamp 232 through a second node 202. A cathode of the first diode D1 is connected to a cathode of the second diode D2 through a third node 203.

The current feedback circuit 240 includes a first voltage dividing resistor R1, a second voltage dividing resistor R2 and a first output end 241. The first output end 241 is connected to the third node 203 through the first voltage dividing resistor R1, and is grounded through the second voltage dividing resistor R2. The first output end 241 is connected to the current sampling end 211, to output the current feedback signal to the current sampling end 211.

The over-voltage feedback circuit 250 includes a third voltage dividing resistor R3, a fourth voltage dividing resistor R4 and a second output end 251. The second output end 251 is connected to the third node 203 through the third voltage dividing resistor R3, and is grounded through the fourth voltage dividing resistor R4. The second output end 251 is connected to the voltage sampling end 212, to output the over-voltage feedback signal to the voltage sampling end 212.

The pulse feedback circuit 260 includes a fifth voltage dividing resistor R5, a sixth voltage dividing resistor R6, a seventh voltage dividing resistor R7, a coupling capacitor C2, a third diode D3, a fourth diode D4 and a third output end 261. The first node 201 is grounded through the fifth voltage dividing resistor R5 and the seventh voltage dividing resistor R7. The second node 202 is connected to the fifth voltage dividing resistor R5 and the seventh voltage dividing resistor R7 through the sixth voltage dividing resistor R6. Between the fifth voltage dividing resistor R5 and the seventh voltage dividing resistor R7 is a fourth node 204. The fourth node 204 is connected to an anode of the third diode D3 through the coupling capacitor C2. A cathode of the third diode D3 is connected to the pulse sampling end 213 through the third output end 261. An anode of the fourth diode D4 is grounded. A cathode of the fourth diode D4 is connected to the anode of the third diode D3. The fifth voltage dividing resistor R5 and the sixth voltage dividing resistor R6 have the same resistance.

The voltage Vif of the current feedback signal is changed after it is filtered by the filtering capacitor C1 connected to the current sampling end 211. The voltage of the feedback signal received by the first comparator 215 is defined as V1. Similarly the voltage Vvf of the over-voltage feedback signal is changed after it is filtered by the filtering capacitor C1 connected to the voltage sampling end 212. The voltage of the feedback signal received by the second comparator 216 is defined as V2.

In the backlight protection circuit 200, when the voltage V1 is lower than the first reference voltage Vref1, the pulse modulator 210 gradually changes the duty cycle of control pulses output at the output end 214 so as to increase the AC voltage output by the driving circuit 220 until the voltage V1 is no longer lower than the first reference voltage Vref1. When the voltage V2 exceeds the second reference voltage Vref2, or when the pulse sampling end 203 receives the pulse signal, the pulse modulator 210 stops control pulses from the output end 214 and latches the pulse modulator 210.

Operation of the backlight protection circuit 200 follows.

Figure 2:
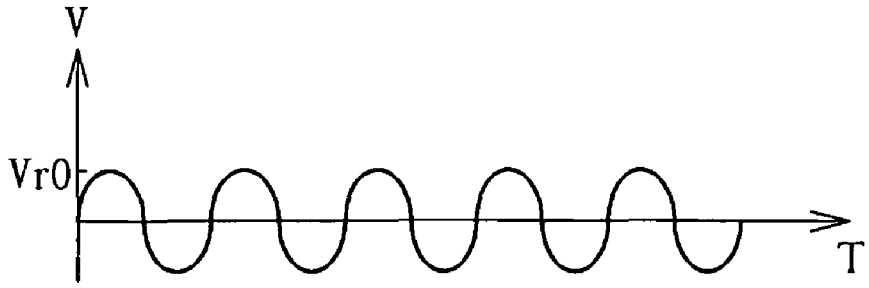
FIGS. 2 to 5 are embodiments of waveforms at certain nodes when the backlight protection circuit in FIG. 1 is in normal operation.
Figure 3:
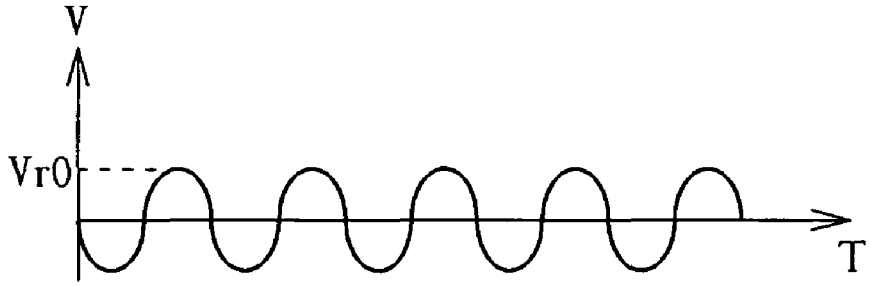
Figure 4:
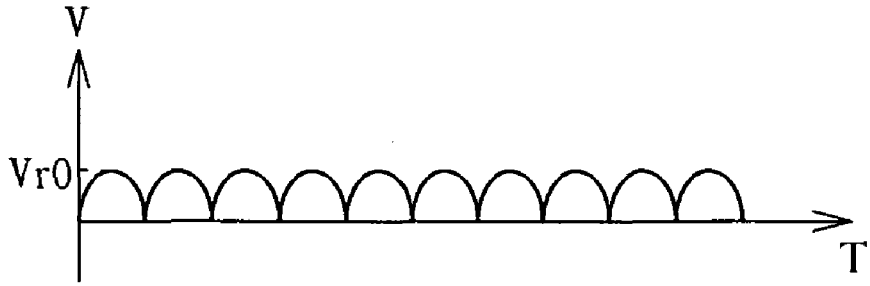

FIGS. 2 to 5 are embodiments of waveforms at certain nodes when the backlight protection circuit 200 is in normal operation. For example, if driving voltage imposed on the high voltage end of the first lamp 231 is a high AC voltage, and the effective voltage of the high AC voltage is approximately 600V, after the high AC voltage is dropped by the first lamp 231, the amplitude Vr1 of the voltage at the first node 201 is about 10V. As shown in FIG. 2, the voltage at the first node 201 is a sinusoidal wave $Vr_o \cdot \sin(2\pi ft)$, where f is the frequency of the AC voltage output by the transformer 222. The driving voltages imposed on the first and second lamps 231 and 232 have the same magnitude and opposite phases. The first and second lamps 231 and 232 exhibit the same electrical characteristics. Thus the waveform at the second node 202 is as shown in FIG. 3. That is, during normal operation, the voltage at the second node 202 has the same magnitude as the first node 201, with opposite polarity. The voltage at the second node 202 is about $-Vr_o \cdot \sin(2\pi ft)$ or $Vr_o \cdot \sin(2\pi ft+\pi)$.

Figure 5:
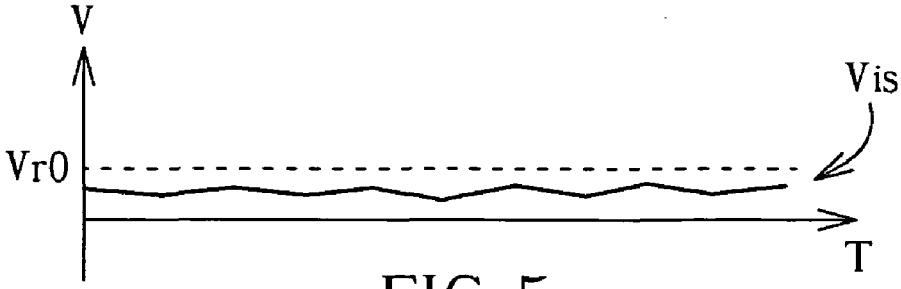

The unidirectional electric current property of a diode turns the diode on when the anode voltage exceeds its cathode voltage. If the voltage drops across the first and second diodes D1 and D2 are ignored, the voltage at the first node 201 and the voltage at the second node 202 cause the voltage at the third node 203 to have the waveform shown in FIG. 4 which is the absolute value of a sinusoidal wave $|Vr_o \cdot \sin(2\pi ft)|$. Because the third node 203 is grounded through the first voltage dividing resistor R1 and the second voltage dividing resistor R2, and is grounded through the third voltage dividing resistor R3 and the fourth voltage dividing resistor R4, the voltage Vif at the first output end 241 is $|R_2 \cdot Vr_o \cdot \sin(2\pi ft)/(R_1+R_2)|$, the voltage Vvf at the second output end 251 is $|R_4 \cdot Vr_o \cdot \sin(2\pi ft)/(R_3+R_4)|$. The voltage Vif at the first output end 241 is filtered by the filtering capacitor C1 and then transmitted to the first signal end 2151, thus the voltage Vis at the first signal end 2151 is smoother than the voltage Vif at the first output end 241, more like a stable positive DC voltage. The voltage Vis is proportional to the voltage Vif and lower than the voltage Vif as shown in FIG. 5. The voltage Vvf at the second output end 251 is filtered by the filtering capacitor C1 and then transmitted to the second signal end 2161, thus the voltage Vvs at the second signal end 2161 is smoother than the voltage Vvf at the second output end 251, more like a stable positive DC voltage. The voltage Vvs is proportional to the voltage Vvf and lower than the voltage Vvf. The waveform of the voltage Vvs is similar to the waveform of the voltage Vis.

Because the resistance of the fifth voltage dividing resistor R5 and the resistance of the sixth voltage dividing resistor R6 are the same, the voltages at the first node 201 and the second node 202 have the same magnitude but opposite polarity. Thus the voltage at the fourth node 204 is zero. The third diode D3 is turned off, and the third output end 261 has no signal output.

When an abnormal situation occurs in the backlight protection circuit 200, such as the output voltage Vo of the transformer 222 being too high, above the highest allowable effective voltage Voh, leaving the lamp in the lamp set 230 in danger of being burned out, the voltages Vr0 of the low voltage ends of the first and second lamps 231 and 232 both rise to exceed the higher voltage limit Vh of the low voltage ends of the first and second lamps 231 and 232 to increase the voltage Vvs of the second signal end 2161 to be above the second reference voltage Vref2 so as to control the pulse modulator 210 to stop outputting pulses thereby stopping the transformer 222 from outputting a high AC voltage.

When the output voltage Vo of the transformer 222 is too low, below the allowable lowest effective voltage Vol, causing the lamp in the lamp set 230 unable to emit sufficient light, the voltages Vr0 of the low voltage ends of the first and second lamps 231 and 232 both drop to below the lower voltage limit V1 of the low voltage ends of the first and second lamps 231 and 232 to reduce the voltage Vis of the first signal end 2151 to be below the first reference voltage Vref1 so as to control the pulse modulator 210 to adjust the duty cycle of its output pulses thereby increasing the high AC voltage Vo output by the transformer 222 and causing the lamp in the lamp set 230 to emit sufficient light.

Figure 6:
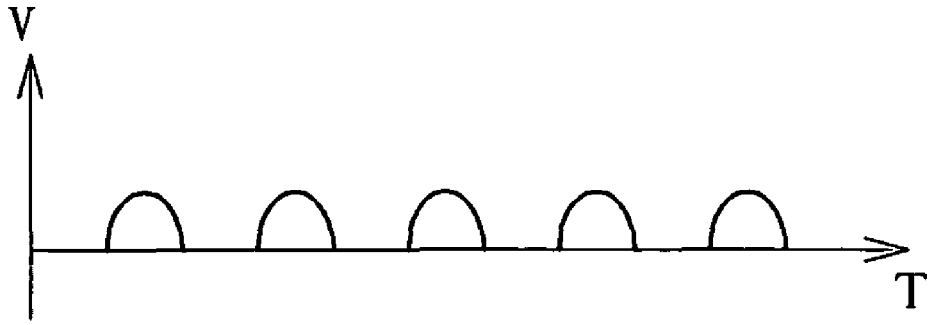
FIG. 6 is a waveform of the voltage at the third output end in FIG. 1 when the voltage of the first node in FIG. 1 is zero.

When the first lamp 231 is removed or open circuits, the voltage Vr0 at the low voltage end of the first lamp 231 becomes zero because the low voltage end of the first lamp 231 is grounded through the protecting resistor R0. That is, the voltage of the first node 201 becomes zero. FIG. 6 is a waveform of the voltage at the third output end 261 when the voltage of the first node 201 is zero. When the voltage of the first node 201 is zero, the voltage at the fourth node 204 is about $-R_7 \cdot Vr_o \cdot \sin(2\pi ft)/(R_6+R_7)$, having a magnitude exceeding the voltage drop of the third diode D3. After the voltage of the fourth node 204 drops due to the voltage drop across the coupling capacitor C2 and the third diode D3, the voltage at the third output end 261 is as shown in FIG. 6. The pulse sampling end 213 collects the pulse signal from the third output end 261, and the pulse modulator 210 stops control pulses to stop the transformer 222 from outputting AC voltage, thereby protecting other lamps which have not encountered the abnormal situation. When the second lamp 232 is removed or open circuits and triggers an abnormal situation for lamp set 230, the voltage at the fourth node 204 becomes about $R_7 Vr_o \cdot \sin(2\pi ft)/(R_5+R_7)$, and third output end 261 outputs a pulse signal similar to that shown in FIG. 6 to stop the pulse modulator 210 from outputting control pulses, thereby the transformer 222 stops outputting the AC voltage.

When the third lamp 233 is removed or open circuits, the voltages imposed on the first lamp 231 and the third lamp 233 are both imposed on the first lamp 231. Thus the voltage at the high voltage end of the first lamp 231 doubles, making the voltage at the first node 201 about $2Vr_o \cdot \sin(2\pi ft)$. Because the fifth and sixth voltage dividing resistors R5 and R6 have the same resistance, the voltage at the fourth node 204 is about $R_7 \cdot Vr_o \cdot \sin(2\pi ft)/(R_5+R_7)$, the same as when the second lamp 232 is removed or open circuits. Then, the pulse sampling end 213 of the pulse modulator 210 receives the pulse signal from the third output end 261, and the pulse modulator 210 directs its output end 214 to stop control pulses to stop the transformer 222 from outputting AC voltage. Similarly, when the fourth lamp 234 is removed or open circuits, the pulse modulator 210 stops outputting control pulses to stop the transformer 222 from outputting the AC voltage.

As can be seen, when any lamp of lamp set 230 open circuits, the voltage at the first node 201 or the second node 202 becomes abnormal. The pulse sampling end 213 of the pulse modulator 210 receives the pulse signal which stops the pulse modulator 210 from outputting control pulses. Further, when taking the voltage drop of the third diode D3 into consideration, by selecting appropriate resistance for the resistors R5, R6 and R7, the difference between the current of the first lamp 231 and the current of the second lamp 232 can be kept within a predetermined range. When the difference between the current of the first lamp 231 and the current of the second lamp 232 falls outside the predetermined range, the pulse modulator 210 stops outputting control pulses.

Figure 7:
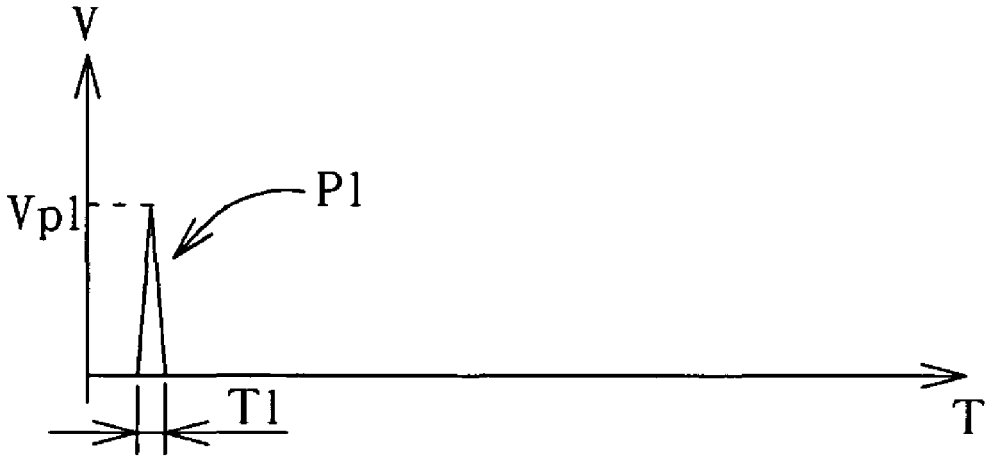
FIGS. 7 and 8 show two kinds of high frequency acute pulses.
Figure 8:
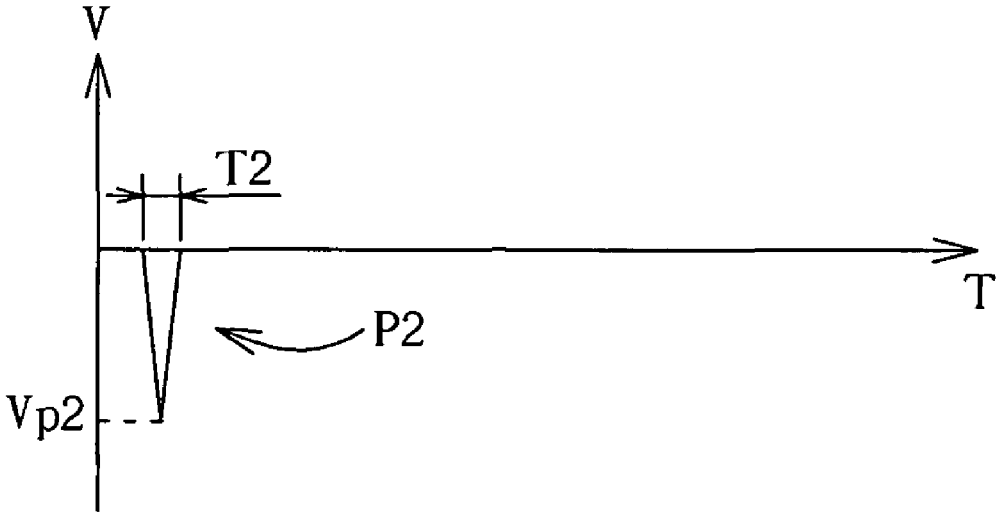

In addition to the abnormal situations described, when a strong current pulse (e.g., a power surge) passes through one of the lamps of the lamp set 230, such as during a power surge, the fourth node 204 of the backlight protection circuit 200 experiences a high frequency pulse. FIGS. 7 and 8 show two kinds of such high frequency acute pulses. FIG. 7 shows a positive high frequency acute pulse P1 with initial voltage and end voltage both zero. The duration T1 of the positive high frequency acute pulse P1 is far less than the period of AC voltage generated by the transformer 222 such as 0.1/f or even less. During duration T1, the voltage is always positive, and the peak value Vp1 exceeds the voltage $R_7 \cdot Vr_o/(R_5+R_7)$, such as $10R_7 \cdot Vr_o/(R_5+R_7)$ or even greater. FIG. 8 shows a negative high frequency acute pulse P2, differing from the positive high frequency acute pulse P1 in that during its duration T2, voltage remains negative, and the peak value Vp2 is far below voltage $-R_7 \cdot Vr_o/(R_5+R_7)$, such as $-10R_7 \cdot Vr_o/(R_5+R_7)$ or even less. When the fourth node 204 experiences positive high frequency acute pulse P1, the coupling capacitor C1 is fully charged rapidly. The positive high frequency acute pulse P1 passes through the coupling capacitor C1 and the third diode D3, and is output from the third output end 261. When the fourth node 204 experiences the negative high frequency acute pulse P2, while the voltage of the negative high frequency acute pulse P2 is dropping, the fourth diode D4 is turned on and the coupling capacitor C2 is charged. Because diodes can be clamped, and the voltage at a cathode of the fourth diode D4 is lower than zero, the terminal of the coupling capacitor C2 connected to the fourth diode D4 is charged with positive charges, and terminal of the coupling capacitor C2 connected to the fourth node 204 is charged with negative charges. As the voltage of the negative high frequency acute pulse P2 rises, the coupling capacitor C2 is completely charged. Because the potential difference between two terminals of a capacitor cannot change suddenly, when the negative high frequency acute pulse P2 rises rapidly, the voltage at the cathode of the fourth diode D4 does as well, switching off the fourth diode D4 and switching on the third diode D3. At this time, the coupling capacitor C2 starts to discharge, whereby a pulse signal is generated at the third output end 261. Accordingly, it can be seen that when a strong abrupt current passes through one of the lamps of the lamp set 230, a high frequency acute pulse is generated at the fourth node 204, and a feedback pulse signal is generated at the third output end 261. At this time, the pulse modulator 210 detects the feedback pulse signal at the pulse sampling end 213 and stops the pulse modulator 210 from outputting control pulses, thereby stopping the transformer 222 from outputting the AC voltage and protecting other lamps of the lamp set 230.

The over-voltage feedback circuit 250 of the backlight protection circuit 200 is connected to the low voltage ends of the lamps of the lamp set 230 through the first diode D1, thus the elements of the over-voltage feedback circuit 250 do not wear easily, increasing the reliability of, specifically, the over-voltage feedback circuit 250, and, commensurately, the backlight protection circuit 200.

Further, the backlight protection circuit 200 has fewer elements, simpler structure, lower cost and lower power consumption. The over-voltage feedback circuit 250 of the backlight protection circuit 200 is connected to the low voltage ends of the lamps of the lamp set 230. Because the low voltage ends of the lamps of the lamp set 230 have less voltage fluctuation, the current in the lamps is more stable and precise. Due to their known imprecision, the over-voltage feedback circuit 250 does not use any capacitive elements, increasing the precision of the over-voltage feedback signal. All of the feedback circuits of the backlight protection circuit 200 are connected to the low voltage ends of the lamps of the lamp set 230, thus all of the feedback circuits of the backlight protection circuit 200 can be integrated to an integrated circuit, simplifying the backlight protection circuit 200. Because the pulse feedback circuit 260 of the backlight protection circuit 200 generates the feedback pulse signal, the backlight protection circuit 200 is able to provide open circuit protection, balance the current flowing through the lamps, and prevent damage from lightening or other electrical outages.

In another embodiment, the anode of the third diode D3 can be connected to the third output end 261, the cathode of the third diode D3 can be connected to the coupling capacitor C2, the cathode of the fourth diode D4 can be connected to ground, and the anode of the fourth diode D4 can be connected to the cathode of the third diode D3. To serve the purpose of the present disclosure, the backlight protection circuit 200 does not need to include the current feedback circuit 240 and the pulse feedback circuit 260. Also in another embodiment, the backlight protection circuit 200 does not need to include the over-voltage feedback circuit 250 and the pulse feedback circuit 260. Further in yet another embodiment, the backlight protection circuit 200 can only include the driving circuit 220, the lamp set 230 and a modulation integrated circuit. The modulation integrated circuit includes the pulse modulator 210, current feedback circuit 240, over-voltage feedback circuit 250, pulse feedback circuit 260, first diode D1, second diode D2, first node 201 and second node 202. The first node 201 and second node 202 are input ports of the modulation integrated circuit. The output end 214 of the pulse modulator 210 is an output port of the modulation integrated circuit.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the fill extent indicated by the broad general meaning of the terms in which the appended claims are expressed.

What is claimed is:

1. A backlight protection circuit comprising:

a driving circuit;

a first lamp, comprising a high voltage end connected to the driving circuit and a low voltage end;

a second lamp, comprising a high voltage end connected to the driving circuit and a low voltage end;

a pulse modulator to control operation of the driving circuit, the pulse modulator comprising a voltage sampling end;

an over-voltage feedback circuit electrically connecting the low voltage end of the first lamp to the voltage sampling end of the pulse modulator, and electrically connecting the low voltage end of the second lamp to the voltage sampling end of the pulse modulator;

a first diode connected between the low voltage end of the first lamp and the over-voltage feedback circuit; and a second diode connected between the low voltage end of the second lamp and the over-voltage feedback circuit; and a pulse feedback circuit connected to the low voltage end of the first lamp, the low voltage end of the second lamp, and the pulse modulator, wherein the pulse feedback circuit comprises:

a first voltage dividing resistor connected to the low voltage end of the first lamp;

a second voltage dividing resistor connected between the low voltage end of the second lamp and the first voltage dividing resistor;

a third voltage dividing resistor having a first end connected to the first voltage dividing resistor and the second voltage dividing resistor, and a second end grounded;

a coupling capacitor having a first end connected to the first, second and third voltage dividing resistors, and a second end;

a third diode connected between the pulse modulator and the second end of the coupling capacitor; and a fourth diode connected between the second end of the coupling capacitor and ground, wherein when a voltage of the low voltage end of the first or second lamp exceeds a first reference voltage, the pulse modulator directs the driving circuit to stop operation.

2. The backlight protection circuit of claim 1, wherein the pulse modulator comprises a comparator including a signal end connected to the over-voltage feedback circuit and grounded through a filtering capacitor, and a reference end to receive a reference voltage.

3. The backlight protection circuit of claim 1, wherein the driving circuit includes a switch circuit connected to an output end of the pulse modulator, and a transformer including a primary winding and two secondary windings, the two secondary windings comprising a same number of turns and are wound in a same direction, the backlight protection circuit further comprises a third lamp and a fourth lamp connected in series through one of the secondary windings, the second lamp and the fourth lamp are connected in series through another one of the secondary windings, and the first lamp and the fourth lamp are connected to same transformer terminals of the two secondary windings.

4. The backlight protection circuit of claim 3, wherein a low voltage end of each of the lamps is grounded through a protecting resistor.

5. The backlight protection circuit of claim 1, wherein an anode of the first diode is connected to the low voltage end of the first lamp, an anode of the second diode is connected to the low voltage end of the second lamp, and a cathode of the first diode is connected to a cathode of the second diode and the over-voltage feedback circuit.

6. The backlight protection circuit of claim 5, wherein the over-voltage feedback circuit comprises a fourth voltage dividing resistor connected between the cathode of the first diode and the pulse modulator, and a fifth voltage dividing resistor having a first end connected to the fourth voltage dividing resistor and the pulse modulator, and a second end grounded.

7. The backlight protection circuit of claim 1, further comprising a current feedback circuit connected between the first diode and the pulse modulator.

8. The backlight protection circuit of claim 7, wherein the pulse modulator comprises a comparator including a signal end connected to the current feedback circuit and grounded through a filtering capacitor, and a reference end to receive a reference voltage.

9. The backlight protection circuit of claim 7, wherein an anode of the first diode is connected to the low voltage end of the first lamp, an anode of the second diode is connected to the low voltage end of the second lamp, and a cathode of the first diode is connected to a cathode of the second diode and the current feedback circuit.

10. The backlight protection circuit of claim 9, wherein the current feedback circuit comprises a fourth voltage dividing resistor connected between the cathode of the first diode and the pulse modulator, and a fifth voltage dividing resistor having a first end connected to the first voltage dividing resistor and the pulse modulator, and a second end grounded.

11. The backlight protection circuit of claim 10, wherein the fourth and fifth voltage dividing resistors have a same resistance.

12. The backlight protection circuit of claim 10, wherein an anode of the third diode is connected to the second end of the coupling capacitor, a cathode of the third diode is connected to the pulse modulator, an anode of the fourth diode is grounded, and a cathode of the fourth diode is connected to the anode of the third diode.

13. The backlight protection circuit of claim 10, wherein a cathode of the third diode is connected to the second end of the coupling capacitor, an anode of the third diode is connected to the pulse modulator, a cathode of the fourth diode is grounded, and an anode of the fourth diode is connected to the cathode of the third diode.

* * * * *